US008163167B2

(12) United States Patent
Himelfarb

(10) Patent No.: US 8,163,167 B2
(45) Date of Patent: Apr. 24, 2012

(54) PROCESS FOR THE DEEP DESULFURIZATION OF HEAVY PYROLYSIS GASOLINE

(75) Inventor: Paul Benjerman Himelfarb, Leipzig (DE)

(73) Assignee: Shell Oil Company, Houston, TX (US)

( * ) Notice: Subject to any disclaimer, the term of this patent is extended or adjusted under 35 U.S.C. 154(b) by 733 days.

(21) Appl. No.: 12/208,410

(22) Filed: Sep. 11, 2008

(65) Prior Publication Data

US 2010/0288679 A1 Nov. 18, 2010

Related U.S. Application Data

(60) Provisional application No. 60/973,336, filed on Sep. 18, 2007.

(51) Int. Cl.
*C10G 45/36* (2006.01)
*C10G 45/32* (2006.01)
*C10G 9/16* (2006.01)

(52) U.S. Cl. ..... 208/48 R; 208/57; 208/98; 208/143; 208/144; 208/210; 208/216 R; 208/217; 208/251 R

(58) Field of Classification Search ..... 208/48 R, 208/57, 98, 143, 144, 210, 216 R, 217, 251 R
See application file for complete search history.

(56) References Cited

U.S. PATENT DOCUMENTS

| | | | | |
|---|---|---|---|---|
| 3,239,453 | A | 3/1966 | Halik et al. | 208/27 |
| 3,556,983 | A | 1/1971 | Kronig et al. | 208/27 |
| 3,691,066 | A | 9/1972 | Carruthers et al. | 208/255 R |
| 4,059,504 | A | 11/1977 | Bauer | 208/255 |
| 4,113,603 | A | 9/1978 | Bauer | 208/89 |
| 5,484,578 | A | 1/1996 | Muldowney et al. | 422/220 |
| 5,635,145 | A | 6/1997 | Den Hartog et al. | 422/191 |
| 5,935,413 | A * | 8/1999 | Boyd et al. | 208/49 |
| 2004/0037759 | A1 | 2/2004 | Van Vliet et al. | 422/195 |
| 2005/0014639 | A1 | 1/2005 | Bhan et al. | 502/313 |
| 2006/0060510 | A1 | 3/2006 | Bhan | 208/213 |
| 2006/0237345 | A1 | 10/2006 | Bhan et al. | 208/216 R |
| 2007/0241467 | A1 | 10/2007 | Sevenhuijsen et al. | 261/97 |

FOREIGN PATENT DOCUMENTS

WO WO2006079023 7/2006

* cited by examiner

*Primary Examiner* — Prem C Singh

(57) ABSTRACT

A process for the deep desulfurization of a heavy pyrolysis gasoline to very low levels of organic sulfur, e.g., 30 ppmv or less, with minimal octane number loss through aromatics saturation. The deep desulfurization is accomplished by contacting the heavy pyrolysis gasoline feedstock, partially in liquid and partially in gaseous phase, with a hydrogen treat gas containing a minimum $H_2S$ level in the presence of a hydrogenation catalyst in a one or two reactor system operated in trickle flow, using a low temperature, moderate pressure operating condition.

11 Claims, 2 Drawing Sheets

PROCESS FOR THE DEEP DESULFURIZATION OF HEAVY PYROLYSIS GASOLINE

This application claims the benefit of U.S. Provisional Application No. 60/973,336, filed Sep. 18, 2007, which is incorporated herein by reference.

The present invention is directed to a process for the deep desulfurization of heavy pyrolysis gasoline to produce a very low sulfur content gasoline or gasoline blending stock with a relatively high octane number.

Heavy pyrolysis gasoline (also referred to as "heavy pygas") is a liquid by-product of the steam cracking process to make ethylene and propylene. Heavy pyrolysis gasoline is a highly unsaturated hydrocarbon mixture (carbon range of about $C_7$-$C_{10-11}$) which contains diolefins and alkenyl aromatics (e.g., styrene), as well as mono olefins and a high content of aromatics, the latter of which are desirable in that they contribute to the relatively high octane number of heavy pyrolysis gasoline. In addition, heavy pyrolysis gasoline contains undesirable hetroatom-containing hydrocarbons such as organic sulfur compounds, which must be reduced to low levels in order to allow the use of heavy pyrolysis gasoline as a gasoline product or gasoline blending stock. However in the reduction of organic sulfur compounds to very low levels, it is important that favorable aromatic compounds, which contribute to high octane number, are not converted to less desirable compounds.

One early process for the hydrogenation of pyrolysis gasoline is disclosed in U.S. Pat. No. 3,556,983. This process includes two steps with the diolefins of the pyrolysis gasoline being selectively hydrogenated in the first step and, thereafter, the hydrocarbon from the first step is further hydrogenated in a second step. The catalyst used in both of the hydrogenation steps is noble metal on an aluminum spinel support. The starting feed, i.e. pyrolysis gasoline, is desulfurized to an appreciable extent in addition to having the olefins removed.

U.S. Pat. No. 3,691,066 discloses a process for the selective hydrogenation of gasoline produced by thermal cracking, i.e., pyrolysis gasoline, that contains diolefins, monoolefins, aromatics and sulfur compounds, to reduce the diolefin content and organic sulfur content. The catalyst used in this process is a supported nickel catalyst. The catalyst contains from 1 to 50% wt nickel on a refractory support with the nickel being at least partially sulfided with a sulfur nickel atomic ratio in the range of from 0.01 to 0.4.

U.S. Pat. No. 4,059,504 discloses the selective hydrogenation of dienes and mercaptan sulfur contained in a pyrolysis gasoline in a process using a catalyst that is cobalt-tungsten sulfide supported on a high surface area alumina.

U.S. Pat. No. 4,113,603 discloses a two-step process for hydrotreating a pyrolysis gasoline containing dienes and mercaptan sulfur. The first step provides for mercaptan sulfur reduction using a non-noble metal catalyst. The first step is followed by a second step that provides for diene reduction using a noble metal catalyst. The yielded product is doctor sweet.

In view of the requirements for gasolines and gasoline blending stocks to have significantly lower levels of sulfur, there is the need in the art for a process which will reduce the sulfur content of heavy pyrolysis gasoline to very low levels, e.g., less than 30 ppm, and preferably less than 15 ppm, without a significant reduction of its octane number. The present invention provides such a deep desulfurization process.

SUMMARY OF THE INVENTION

The present invention provides a process for the deep desulfurization of a heavy pyrolysis gasoline feedstock, containing diolefin compounds, organic sulfur compounds and a high concentration of aromatic compounds, in a manner which allows for the removal of the diolefin and organic sulfur compounds to very low levels while not hydrogenating significant amounts of the octane boosting aromatic compounds.

The inventive process provides for the deep desulfurization of a heavy pyrolysis gasoline feedstock containing a diolefin concentration, an organic sulfur concentration and a high aromatic concentration by heating said heavy pyrolysis gasoline feedstock to a temperature sufficient to provide a heated pyrolysis gasoline feedstock having a substantial portion that is in a gaseous phase and another substantial portion that is in a liquid phase; introducing said heated pyrolysis gasoline feedstock that is in said liquid phase and said gaseous phase into a reactor vessel, or more than one reactor vessel in series flow arrangement, that contains a hydrogenation catalyst and is operated in a downflow mode; contacting said heated pyrolysis gasoline feedstock in the presence of an added hydrogen treat gas having an $H_2S$ concentration of at least 100 ppmv with said hydrogenation catalyst at a moderate temperature condition effective to selectively hydrogenate a substantial portion of the diolefins contained in said heated pyrolysis gasoline feedstock to monoolefins and a substantial portion of the organic sulfur in said heated pyrolysis gasoline feedstock to $H_2S$, but not at a temperature to significantly hydrogenate the aromatic compounds contained in said heated pyrolysis gasoline feedstock; yielding from said reactor vessel, or more than one reactor vessel in series flow arrangement, a reactor effluent; and separating $H_2S$ and unreacted hydrogen from said reactor effluent and recovering from said reactor effluent a low-sulfur pyrolysis gasoline product that contains less than 30 ppm organic sulfur compounds.

Figure 1:
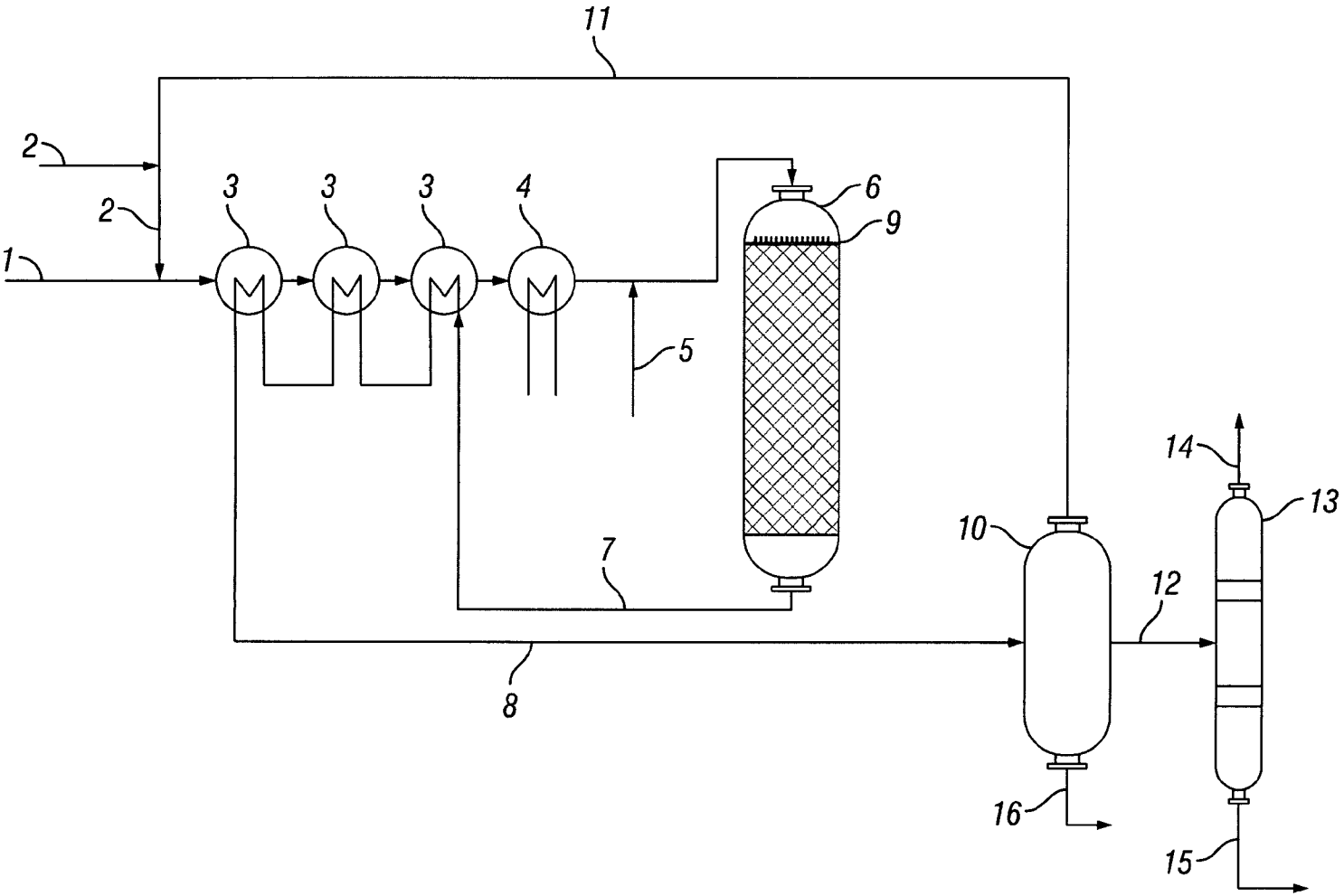
FIG. 1 is a flow diagram in schematic form of one embodiment of the present process for the deep desulfurization of heavy pyrolysis gasoline which utilizes a single reactor vessel operated in a downflow (trickle flow) mode and utilizes a steam heat exchanger to heat the feedstock to a temperature it is substantially in both liquid and gaseous phase.

The feed to the present process comprises a $C_7$+ pyrolysis gasoline stream (hereafter referred to as "heavy pyrolysis gasoline") having a diolefin concentration, an organic sulfur concentration and a high content of aromatics. Generally, the heavy pyrolysis gasoline comprises hydrocarbons boiling in the range of from about 90° C. to about 250° C., and, thus, can have an initial boiling temperature of about 90° C. and a final boiling temperature (end point) of about 250° C., using recognized ASTM methods of measurement. A more typical boiling range for the heavy pyrolysis gasoline is from 100° C. to 230° C.

The aromatic compounds of the heavy pyrolysis gasoline stream may include, for example, such compounds as toluene, styrene, ethylbenzene, xylene, cumene and other alkyl substituted benzene compounds. The aromatics concentration of the heavy pyrolysis gasoline is significant and may be in the range of from 30 wt % to 85 wt % of the heavy pyrolysis gasoline stream. While it is preferable for the aromatics content to be as significantly high as is possible, it is more typically in the range of from 40 wt % to 75 wt %, and, most typically, it is in the range of from 50 wt % to 70 wt %.

The sulfur compounds contained in the heavy pyrolysis gasoline stream may include, for example, mercaptans, disulfides, monosulfides and thiopheneic compounds. The organic sulfur content of the heavy pyrolysis gasoline feed to the present process will, generally, be in the range of 75 ppmw to 2000 ppmw, and, more particularly, from 80 ppmw to 1000 ppmw. But, more typically, the organic sulfur concentration is in the range of from 90 ppmw to 500 ppmw, and most typically, from 100 ppmw to 400 ppmw.

Typically, heavy pyrolysis gasoline directly from a steam cracking unit will also contain a significant amount of unsaturates including diolefins and alkenyl aromatics. Such highly reactive compounds in significant concentrations, will polymerize and cause catalyst bed plugging and pressure drop build-up, and they can contribute to catalyst deactivation. In order to minimize this, it is preferred that the heavy pyrolysis gasoline feedstock to the present process be subjected to a prior hydrotreatment under mild conditions (i.e., "first stage" hydrogenation) to convert a significant fraction of the diolefins and alkenyl aromatics to mono olefins and alkyl aromatics, respectively. Thus, the present process can be viewed as a "second stage" hydrogenation process, since the heavy pyrolysis gasoline feedstock to the present process will preferably have already been hydrotreated to reduce the diolefin and alkenyl aromatics content to a lower concentration level of in the range of from 0.01 wt % (100 ppmw) to 5 wt %. It is preferred for this hydrogenation step to provide a diolefin concentration in the heavy pyrolysis gasoline feedstock to the process of the invention of less than 3 wt %. Thus, for example, the diolefin concentration may be in the range of from 100 ppmw to 3 wt %, more preferably, the diolefin concentration is less than 2 wt %, e.g., from 200 ppmw to 2 wt %, and, most preferably, it is less than 1 wt %, e.g. from 250 ppmw to 1 wt %.

An important feature of the present process is for the heavy pyrolysis gasoline feedstock to be heated to a temperature so as to provide a feed that is introduced into the reactor vessel that is partially in the liquid phase and partially in the gaseous phase. Generally, the percentage of feed in liquid phase will be in the range of from 20 wt % to 90 wt %, with the range of from 40 wt % to 80 wt % being preferred, and the percentage of feed in the gaseous phase will be in the range of from 10 wt % to 80 wt %, with the range of from 20 wt % to 60 wt % being preferred. Normally, the feed will be mostly in the liquid phase as it is charged to the reactor vessel at the start of a run (e.g., from about 50 to about 85 wt %) and mostly in gaseous phase at the end of a run (e.g. from about 50 to about 75 wt %).

The heavy pyrolysis gasoline feed to the present process may be heated to the desired temperature by use of any suitable heating means, for example, a steam heat exchanger, a fired heater, or by indirect heat exchange with effluent from the reactor vessel or other suitable stream, or by a combination thereof.

Because it is important that a substantial portion of the pyrolysis gasoline feedstock entering the reactor be in liquid phase, as well as in the gaseous phase, the temperature of the heavy pyrolysis gasoline feed entering the reactor in the present process will normally be lower than the temperature in conventional gaseous phase pyrolysis gasoline desulfurization processes. For example, suitable temperatures for the heavy pyrolysis gasoline feed entering the reactor vessel in the present process will be in the range from 175° C. to 275° C., preferably from 200° C. to 260° C.

The heated heavy pyrolysis gasoline feedstock, partially in liquid phase and partially in gaseous phase, upon entering the reactor vessel flows downwardly through one or more fixed beds of catalyst (i.e., in trickle flow) where it is contacted with added hydrogen treat gas containing a minimum level of hydrogen sulfide ($H_2S$) of 100 ppmv. Preferably, the $H_2S$ level in the hydrogen treat gas will be 150 ppmv up to 250 ppmv or more.

It is an important feature of the inventive process for the hydrogen treat gas to have an $H_2S$ concentration in order that the catalyst of the process with which the hydrogen treat gas is contacted will remain completely sulfided and to ensure catalyst selectivity by limiting aromatics saturation. It has been found that the selectivity of the catalyst can decrease with hydrogen treat gas $H_2S$ concentration levels lower than 100 ppmv, which will result in some unwanted aromatics saturation (on the order of 1-2%) with a concomitant decrease in octane number of the end gasoline product and in an undesirable temperature increase across the reactor catalyst beds. Such aromatics saturation and loss in octane number can be avoided by maintaining the aforementioned minimum $H_2S$ content in the hydrogen treat gas. The upper limit for the $H_2S$ concentration is thought to be around 2000 ppmv or even higher. It is preferred for the $H_2S$ concentration to be at least 150 ppmv, and, most preferred, at least 200 ppmv. With the present process using a $H_2S$-containing hydrogen treat gas and a low temperature and moderate pressure operating condition, it is possible to limit octane loss between the heavy pyrolysis gasoline feed and the low-sulfur pyrolysis gasoline product of the inventive process to one octane number (i.e., (R+M)/2) or less.

Various methods can be used to maintain the desired minimum $H_2S$ level in the hydrogen treat gas, including, for example, injection of a sulfiding agent such as DSMO. A preferred sulfiding agent is di-sulfide oil (DSO) from a Merox treating unit. Thus, in one embodiment of the present process DSO is injected at one or more points in the process in an amount sufficient to ensure the proper level of $H_2S$ in the hydrogen treat gas.

Deep desulfurization of the heavy pyrolysis gasoline feedstock is preferably accomplished in the present process in a single reactor operated in trickle flow. However, if desired, more than one reactor, preferably connected in series flow arrangement, can also be used. Thus, another embodiment of the invention involves the use of two reactor vessels, both operated in a downflow (or trickle flow) mode. Using either the one reactor trickle flow system, or the two reactor trickle flow system produces a pyrolysis gasoline product having very low sulfur levels, e.g., less than 30 ppmv, preferably less than 15 ppmv, without a significant loss of octane number through aromatics saturation.

A preferred feature of the present process is that the heavy pyrolysis gasoline feedstock, at the start-of-run, be highly dispersed as it passes through the catalyst beds in the first and second reactor vessels. What is meant by "highly dispersed" is that the hydrocarbon feedstock is distributed across the cross sectional area of the vessel and onto the top surface area of the catalyst bed in a manner that minimizes the radial non-uniformity of fluid flow to and through the catalyst bed.

There are many suitable methods and means known to those skilled in the art for providing the highly dispersed flow of hydrocarbon feedstock to a catalyst bed such as those used in the present process. Any suitable fluid distribution means for dispersedly distributing the hydrocarbon feedstock across the top surface of the catalyst bed may be used in the present process. Some examples of suitable fluid distribution means include, for example, horizontal plates that are perforated with orifices, or apertures, or holes, providing for fluid flow there through and horizontal plates that are operatively equipped with nozzles, or downcomers, or conduits, that provide for fluid flow therethrough. Even such devices as spray nozzles and fluid atomizers may be used as the fluid distribution means for dispersing the hydrocarbon feedstock across the top surface of the catalyst bed. Other examples of various suitable fluid distribution means are disclosed in U.S. Pat. No. 5,484,578 and the patent art cited therein. U.S. Pat. No. 5,484,578 is incorporated herein by reference.

Other fluid distribution trays that may suitably be used are those taught by U.S. Pat. No. 5,635,145 and U.S. Patent Pub. No. US 2004/0037759, both of such disclosures are incorporated herein by reference. The fluid distribution trays described in these publications include, for example, a distribution tray that is provided with a plurality of openings or downcomers for the downward flow of a fluid that may be a multi-phase fluid. A particularly preferred fluid distribution means that may suitably be used to obtain high dispersion of the heavy pyrolysis gasoline feedstock as it flows through the catalyst beds in the present process is the fluid distribution tray and system described in the U.S. Patent Application filed on 18 Apr. 2006 and entitled "Fluid Distribution Tray and Method for the Distribution of a Highly Dispersed Fluid Across a Bed of Contact Material," and having an application Ser. No. 11/406,419, which disclosure is incorporated herein by reference.

Catalysts that are useful in the present process include any hydrogenation catalyst capable of substantially converting the organic sulfur compounds in the pyrolysis gasoline feedstock to $H_2S$ and the dienes in the pyrolysis gasoline feedstock to their respective monoolefins or alkanes, without significantly hydrogenating aromatic compounds. Particularly suitable catalysts comprise nickel/molybdenum or cobalt/molybdenum on a refractory oxide support, such as alumina, silica, silica alumina, titania, zirconia, and combinations thereof. Mixtures of supported nickel/molybdenum and cobalt/molybdenum catalysts can also be employed. A particularly preferred catalyst is nickel/molybdenum on an alumina support, such as DN-200, which is commercially available from Criterion Catalyst Company.

The amount of nickel and/or cobalt in useful catalysts may be in the range of from about 0.01 wt % to about 10 wt %, preferably, from 0.1 wt % to 8 wt %, and, most preferably, from 1 wt % to 6 wt %, with the wt % calculated assuming the metal is in the metal oxide form and based on the total weight of the catalyst. The amount of molybdenum that is in the catalyst may be in the range of from 3 wt % to 30 wt %, preferably, from 4 wt % to 27 wt %, and, most preferably, from 5 wt % to 20 wt %, with the wt % calculated assuming the metal is in the metal oxide form and based on the total weight of the catalyst.

While many of the conventional hydroprocessing catalysts that include a molybdenum component and either a cobalt component or a nickel component, or both such components, that are supported on an inorganic oxide support in the aforementioned concentrations can suitably be used as a hydrogenation catalyst of the inventive process, a number of other novel catalysts may also be employed in the process. For instance, the catalyst described and employed in the process presented in U.S. Patent Application Pub. No. 2006/0237345, entitled "Method for the Selective Hydrodesulfurization of an Olefin Containing Hydrocarbon Feedstock," having a Pub. Date of Oct. 26, 2006, which publication is incorporated herein by reference, may suitably be used in the inventive process of this disclosure. Other new catalysts that may suitably be used in the inventive process are those as described or claimed in U.S. Patent Application Pub. No. 2005/0014639, entitled "Process and Catalyst for the Selective Hydrogenation of Diolefins Contained in an Olefin Containing Stream and for the Removal of Arsenic Therefrom and a Method of Making Such Catalyst," having a Pub. Date of Jan. 20, 2005, and U.S. Patent Application Pub. No. 2006/0060510, entitled "High Activity Hydrodesulfurization Catalyst, a Method of Making a High Activity Hydrodesulfurization Catalyst, and a Process for Manufacturing an Ultra-low Sulfur Distillate Product," having a Pub. Date of Mar. 23, 2006. Both U.S. Pub. No. 2005/0014639 and U.S. Pub. No. 2006/0060510 are incorporated herein by reference.

In the present deep desulfurization process, the pyrolysis gasoline feedstock is contacted with an $H_2S$-containing hydrogen treat gas in the reactor vessel(s) at a relatively low temperature and moderate pressure operating condition. A low temperature and moderate pressure operating condition is meant to be a temperature in the range of from 175° C. to 275° C., and a pressure of from 400 psig to 800 psig. The preferred operating condition for present process is a temperature in the range of from 200° C. to 260° C. and a pressure in the range of from 425 psig to 650 psig. Since the hydrogenation of organic sulfur compounds is an exothermic reaction, there generally will be a temperature differential across the catalyst bed(s), with the reactor outlet temperature normally being somewhat higher than the reactor inlet temperature.

The flow rate at which the heavy pyrolysis gasoline feed is charged to the reactor of the inventive process is generally such as to provide a liquid hourly space velocity (LHSV) in the range of from 0.1 $hr^{-1}$ to 10 $hr^{-1}$. The term "liquid hourly space velocity," means the numerical ratio of the volumetric rate, in volume per hour, at which the heavy pyrolysis gasoline feed is charged to the reactor of the inventive process divided by the volume of catalyst contained in the reactor. The preferred LHSV is in the range of from 0.5 $hr^{-1}$ to 6 $hr^{-1}$, and, most preferred, from 0.8 $hr^{-1}$ to 2.5 $hr^{-1}$.

The hydrogen treat gas should be of significant hydrogen purity with at least about 70 volume percent of the added hydrogen treat gas being molecular hydrogen. It is preferred for the purity of the hydrogen treat gas to exceed 75 volume percent hydrogen, and, it is more preferred for the purity to exceed 80 volume percent hydrogen. Thus, the hydrogen treat gas will, in general, contain molecular hydrogen in the range of from 70 to 99 vol %, typically, of from 75 to 98 vol %, or, more typically, of from 80 to 97.5 vol %. The amount of hydrogen treat gas added to the heavy pyrolysis gasoline feed should be in the range of from about 100 standard cubic feet (SCF) per barrel (bbl) of heavy pyrolysis gasoline feed to about 5,000 SCF/bbl, preferably, in the range of from 250 SCF/bbl to 3,000 SCF/bbl, and most preferably, from 500 SCF/bbl to 2,000 SCF/bbl.

Another embodiment of the present invention involves the use of a "hot hydrogen strip" to extend the catalyst life. The "hot hydrogen strip" will serve to remove gums and fouling material from the catalyst beds that cause increased pressure drops across the reactor(s) and to restore some of the activity to the hydrogenation catalyst that is lost as a result of its use in the hydrogenation of the heavy pyrolysis gasoline feeds.

The hot hydrogen strip may be accomplished by discontinuing the contacting of the heavy pyrolysis gasoline feed with the hydrogenation catalyst by removing feed from the reactor vessel(s) and, thereafter, contacting with the hydrogenation catalyst or otherwise circulating sour hydrogen at a relatively high temperature for an effective period of time to remove gum deposits and other fouling material from the hydrogenation catalyst and to restore at least a portion of the lost catalyst activity to the hydrogenation catalyst. The hot hydrogen strip can also be used to remove liquid hydrocarbon and subsequently dry out the catalyst bed and reactor system prior to a unit shutdown.

The hot hydrogen stripping should be conducted using a high purity hydrogen stream that is sour in that it contains a significant concentration of hydrogen sulfide. The purity of the hot hydrogen stripping gas should be such that it contains molecular hydrogen in the range of from 70 to 99 vol %, preferably, from 75 to 98 vol %, or, more preferably, from 80 to 97.5 vol %. It is also important for the hot hydrogen stripping gas to have a significant hydrogen sulfide concentration that is at least about 350 ppmv, but it is preferred for the hydrogen sulfide concentration to be at least 400 ppmv, and, most preferred, it should be at least 500 ppmv. An upper limit to the concentration of hydrogen sulfide in the hot hydrogen stripping gas is around 2000 ppmv, or even a lower concentration of 1500 ppmv or 1000 ppmv.

It is also important for the temperature at which the hot hydrogen stripping gas to be contacted with the hydrogenation catalyst, after it has been used in the hydrogenation treatment of the heavy pyrolysis gasoline feed, to be a relatively high temperature of at least about 350° C., but, preferably of at least 370° C., more preferably, at least 390° C., and most preferably, at least 400° C. An upper limit for contacting the hot hydrogen stripping gas with the hydrogenation catalyst is around 700° C., or less than 600° C., or even less than 500° C.

The amount of hot hydrogen stripping gas that is passed over the hydrogenation catalyst should be sufficient to remove at least a portion of the gum deposits and fouling materials from the hydrogenation catalyst and to restore at least a portion of the lost catalyst activity to the hydrogenation catalyst. Generally, the rate at which the hot hydrogen stripping gas is passed over the hydrogenation catalyst is such as to provide a gaseous hourly space velocity that is in the range of from 0.1 $hr^{-1}$ to 100 $hr^{-1}$. The hydrogenation catalyst is treated with the hot hydrogen stripping gas for a time or treatment period that is sufficient to remove at least a portion of the gums and fouling materials from the hydrogenation catalyst and to restore a portion of the lost catalyst activity. This may be for a treatment period in the range of from 0.1 hour to 96 hours, but, more typically, for a treatment period in the range of from 1 hour to 72 hours, and, most typically, from 4 hours to 50 hours.

Referring to FIG. 1, in this embodiment of the invention, a heavy pyrolysis gasoline feedstock, which has been previously subjected to first stage hydrogenation to remove a significant fraction of the diolefins and alkenyl aromatics, is passed through line 1 into a series of feed/effluent heat exchangers 3 wherein the temperature of the feedstock is raised by heat exchange with reactor effluent entering the heat exchangers through line 7. Hydrogen treat gas (which may include recycle hydrogen and make-up hydrogen) enters the system through line 2 and mixes with the liquid heavy pyrolysis gasoline feed prior to entering the feed/effluent heat exchangers 3. From the heat exchangers the combined feed and hydrogen treat gas passes into steam heat exchanger 4 where it is further heated to a temperature between about 175° C. and about 275° C., whereupon only a portion of the feed is vaporized, with another substantial portion of the feed (e.g., from 20 wt % to 90 wt %) remaining in liquid phase. The combined stream, partially in gaseous and partially in liquid phase, enters reactor vessel 6 and flows downward in a trickle flow mode through one or more fixed catalyst beds. The effluent from the reactor vessel flows through line 7 to feed/effluent heat exchangers 3, and then through line 8 to the reactor effluent flash drum 10. The reactor effluent flash drum 10 in this embodiment is a three-phase separator where gas, consisting of hydrogen and lighter hydrocarbons, is recovered and recycled through line 11 to the hydrogen system. The liquid hydrocarbon product stream exits flash drum 10 via line 12 and flows into to stripper column 13 where $H_2S$ and lighter hydrocarbons are stripped from the liquid hydrocarbon product and exits the stripper column via line 14. A sour aqueous stream containing ammonium salts leaves the reactor effluent flash drum via line 16. The low-sulfur pyrolysis gasoline product exits the bottom of the stripper column through line 15 and after optional drying can be used as a gasoline or gasoline blending stock. The present invention will allow for the production of a pyrolysis gasoline product with a total organic sulfur content of 30 ppmv or less, and preferably 15 ppmv or less.

The reactor vessel in this example contains one or more beds of mostly nickel/molybdenum on alumina catalyst. The remainder of the bed(s) can be support material and/or low activity grading. A typical temperature rise across the reactors will be on the order of 25-40° F. The feed is mostly in liquid phase (e.g., 60%) in the reactors at the start of run (SOR), and mostly in vapor phase (e.g., 75%) at end of run (EOR).

Each catalyst bed is equipped with high dispersion tray 9 in order to ensure uniform dispersion of the feedstock across the top surface of the catalyst bed.

The reactor will generally be operated at a moderate pressure, e.g., between about 400 psig to about 800 psig, preferably, from 425 psig to 650 psig. A typical start of run pressure drop across the reactors will be in the range of from about 30 to 40 psig, and a typical end of run pressure drop across the reactors will be in the range of from about 40 to about 50 psig.

As previously discussed, an important feature of the present process is that there be a minimum $H_2S$ concentration of 100 ppmv $H_2S$ (preferably greater than 150 ppmv $H_2S$) in the treat gas going to the reactor vessel. In the embodiment shown in FIG. 1, this $H_2S$ concentration is accomplished by injecting through line 5 sufficient amounts of a sulfiding agent such as di-sulfide oil (DSO) from a Merox treating unit into the combined feed/hydrogen treat gas stream. The presence of minimum levels of $H_2S$ in the treat gas will ensure the catalyst will remain fully sulfided and avoid aromatics hydrogenation, thereby minimizing octane loss in the final pyrolysis gasoline product.

Figure 2:
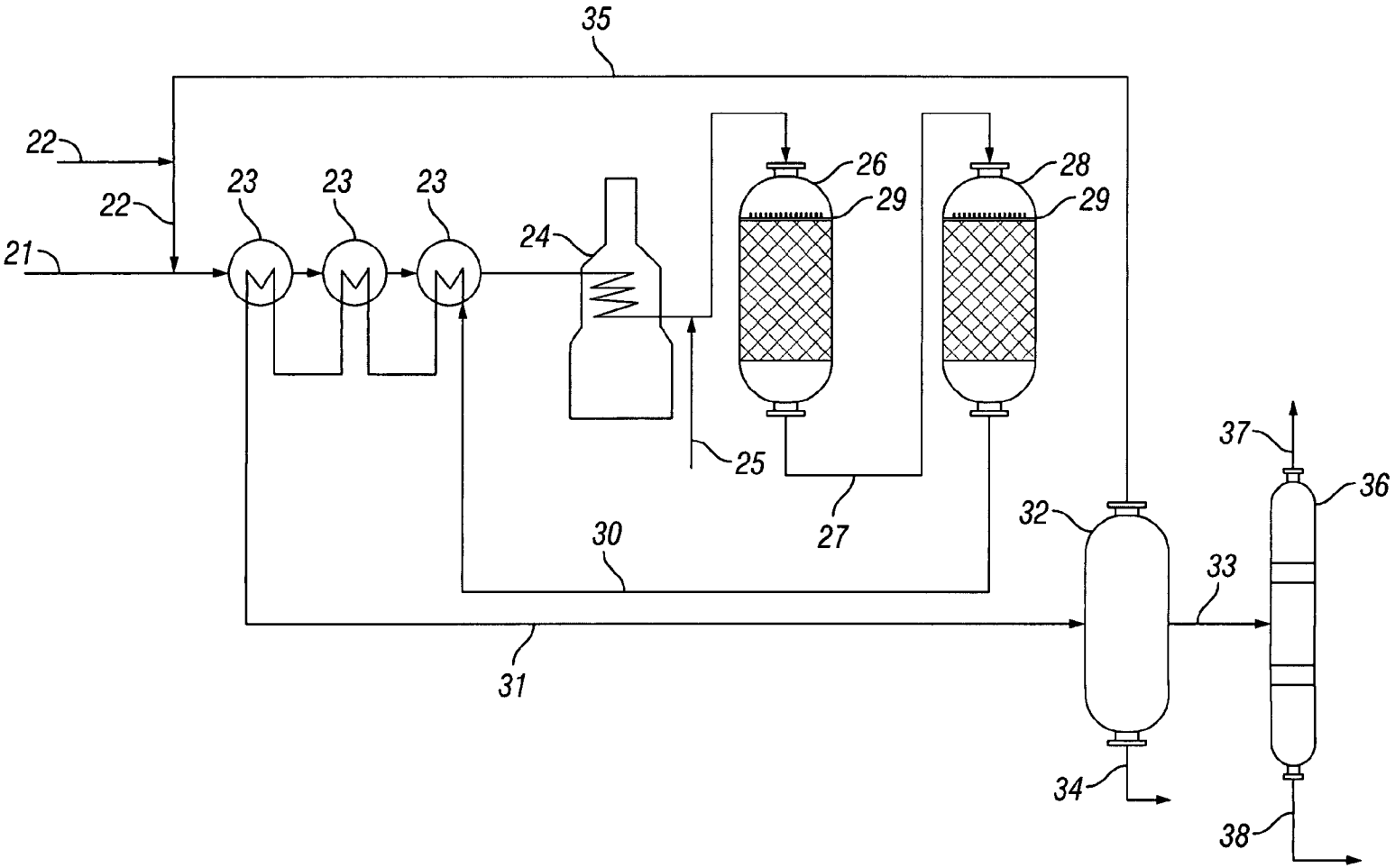
FIG. 2 is a flow diagram in schematic form of another embodiment of the present deep desulfurization process which utilizes two reactor vessels operated in a downflow (trickle flow) mode and utilizes a fired heater to heat the feedstock to a temperature so as to provide the feedstock that is substantially in both liquid and gaseous phases.

Another embodiment of the invention involving a two-step trickle flow reactor system is shown in FIG. 2. In this embodiment a heavy pyrolysis gasoline feedstock, which has been previously subjected to first stage hydrogenation to remove a significant fraction of the diolefins and alkenyl aromatics, is passed through line 21 into a series of heat exchangers 23 wherein the temperature of the feedstock is raised by heat exchange with reactor effluent entering the heat exchangers through line 30. Hydrogen treat gas (which may include recycle hydrogen and make-up hydrogen) enters the system through line 22 and mixes with the liquid heavy pyrolysis gasoline feed prior to entering the feed/effluent heat exchangers 23. From the heat exchangers the combined feed and hydrogen treat gas passes into feed heater 24 (a fired heater) where it is further heated so that it can enter first reactor vessel 26 at the desired temperature, e.g., between 175° C. and 275° C. The combined stream passes in a down flow (or trickle flow) mode through one or more fixed catalyst beds in the first reactor vessel and then flows through line 27 into the second reactor vessel 28 where it passes through one or more additional catalyst beds again in a down flow (or trickle flow) mode.

Each reactor vessel in this example contains one or more beds of mostly nickel/molybdenum on alumina catalyst. The remainder of the bed(s) can be support material and/or low activity grading. A typical temperature rise across the reactors will be on the order of 5 to 50° C. The feed is mostly in liquid phase (e.g., 60%) in the reactors at the start of run (SOR), and mostly in vapor phase (e.g., 75%) at end of run (EOR).

Each catalyst bed is equipped with high dispersion tray 29 in order to ensure uniform dispersion of the feedstock across the top surface of the catalyst bed.

The reactors will generally be operated at a moderate pressure, e.g., between about 400 psig and about 800 psig. A typical pressure drop across the reactors will be in the range of from about 5 to 40 psig at SOR and from 10 to 50 psig at EOR.

As previously discussed, an important feature of the present process is that there be a minimum of 100 ppmv $H_2S$ (preferably 150 ppmv $H_2S$) in treat gas going to the reactor vessels. In the embodiment shown this is accomplished by injecting sufficient amounts of a sulfiding agent such as disulfide oil (DSO) from a Merox treating unit into the combined feed/hydrogen treat gas stream through line 25. The presence of minimum levels of $H_2S$ in the treat gas will ensure the catalyst will remain fully sulfided and avoid aromatics hydrogenation, thereby minimizing octane loss.

The effluent from the second reactor vessel flows through line 30 to the feed/effluent heat exchangers and then through line 31 to the reactor effluent flash drum 32. The reactor effluent flash drum in this embodiment is a three-phase separator where gas, consisting of hydrogen and lighter hydrocarbons, is recovered and recycled through line 35 to the hydrogen system. The liquid hydrocarbon product stream exits flash drum 32 via line 33 and flows into to stripper column 36 where $H_2S$ and lighter hydrocarbons are stripped from the liquid hydrocarbon product and exits the stripper column via line 37. A sour aqueous stream containing ammonium salts leaves the reactor effluent flash drum via line 34. The low-sulfur pyrolysis gasoline product exits the bottom of the stripper column through line 38 and after optional drying can be used as a gasoline or gasoline blending stock. This embodiment of the invention will also produce a pyrolysis gasoline product with a total organic sulfur content of 30 ppmv or less, preferably 15 ppmv or less.

That which is claimed is:

1. A process for the deep desulfurization of a heavy pyrolysis gasoline feedstock containing a diolefin concentration, an organic sulfur concentration and a high aromatic concentration, wherein said process comprises:

heating said heavy pyrolysis gasoline feedstock to a temperature sufficient to provide a heated pyrolysis gasoline feedstock having a substantial portion that is in a gaseous phase and another substantial portion that is in a liquid phase;

introducing said heated pyrolysis gasoline feedstock that is in said liquid phase and said gaseous phase into a reactor vessel, or more than one reactor vessel in series flow arrangement, that contains a hydrogenation catalyst and is operated in a downflow mode;

contacting said heated pyrolysis gasoline feedstock in the presence of an added hydrogen treat gas having an $H_2S$ concentration of at least 100 ppmv with said hydrogenation catalyst at a moderate temperature condition effective to selectively hydrogenate a substantial portion of the diolefins contained in said heated pyrolysis gasoline feedstock to monoolefins and a substantial portion of the organic sulfur in said heated pyrolysis gasoline feedstock to $H_2S$, but not at a temperature to significantly hydrogenate the aromatic compounds contained in said heated pyrolysis gasoline feedstock;

yielding from said reactor vessel, or more than one reactor vessel in series flow arrangement, a reactor effluent; and separating $H_2S$ and unreacted hydrogen from said reactor effluent and recovering from said reactor effluent a low-sulfur pyrolysis gasoline product that contains less than 30 ppm organic sulfur compounds.

2. A process as recited in claim 1, wherein said substantial portion of said heated pyrolysis gasoline feedstock that is in said gaseous phase is in the range of from 10 wt % to 80 wt % of said heated pyrolysis gasoline feedstock and said another substantial portion of said heated pyrolysis gasoline feedstock that is in said liquid phase is in the range of from 20 wt % to 90 wt % of said heated pyrolysis gasoline feedstock.

3. A process as recited in claim 2, wherein said moderate temperature condition includes a contacting temperature in the range of from 175° C. to 275° C., and wherein said reactor vessel is operated at an operating pressure in the range of from 400 psig to 800 psig.

4. A process as recited in claim 3, further comprising: discontinuing the contacting of said heated pyrolysis gasoline feedstock with said hydrogenation catalyst; and, thereafter, contacting said hydrogenation catalyst with a hot hydrogen stream comprising hydrogen and a concentration of $H_2S$ of at least 400 ppmv at a hydrogen treatment temperature of at least 370° C. and for a treatment period sufficient to remove gum deposits and fouling material from said hydrogenation catalyst and to restore at least a portion of lost catalyst activity of said hydrogenation catalyst.

5. A process as recited in claim 4, wherein said diolefin concentration is in the range of from 100 ppmw to 3 wt % of said heavy pyrolysis gasoline feedstock, said organic sulfur concentration is in the range of from 75 ppmw to 2,000 ppmw; and said high aromatics concentration is in the range of from 30 wt % to 85 wt % of the total weight of said heavy pyrolysis gasoline feedstock.

6. A process as recited in claim 5, wherein said hydrogenation catalyst comprises molybdenum and either cobalt or nickel, or both, supported on an inorganic oxide support.

7. A process as recited in claim 6, wherein said low-sulfur pyrolysis gasoline product has a concentration of diolefins of less than 75 ppmw.

8. A process as recited in claim 7, wherein said reactor vessel includes said more than one reactor vessel in series flow arrangement which includes a first reactor vessel that contains a first hydrogenation catalyst and that is operated in said downflow mode and a second reactor vessel that contains a second hydrogenation catalyst and that is operated in said downflow mode, wherein said process comprises:

contacting said heated pyrolysis gasoline feedstock in the presence of said added hydrogen treat gas with said first hydrogenation catalyst at said moderate temperature condition and yielding from said first reactor vessel a first reactor effluent;

contacting said first reactor effluent in the presence of said added hydrogen treat gas with said second hydrogenation catalyst at a desulfurization condition effective to hydrogenate a substantial portion of the organic sulfur compounds contained in said first reactor effluent to $H_2S$, but not at a temperature to significantly hydrogenate the aromatic compounds contained in said first reactor effluent; and yielding from said second reactor vessel a second reactor effluent as said reactor effluent.

9. A process as recited in claim 8, wherein said heavy pyrolysis gasoline feedstock has been previously hydrogenated to selectively convert diolefins and alkenyl aromatics to mono olefins and alkyl aromatics.

10. The process of claim 9, wherein the heavy pyrolysis gasoline feedstock is heated in a steam heat exchanger.

11. The process of claim 10, wherein the reactor vessel contains a fixed catalyst bed equipped with a high dispersion tray to uniformly distribute the pyrolysis gasoline feedstock across the top of the fixed catalyst bed.

* * * * *